US009144728B1

(12) United States Patent
Wachtler

(10) Patent No.: US 9,144,728 B1
(45) Date of Patent: Sep. 29, 2015

(54) GOLF SWING TRAINING AID

(71) Applicant: John A. Wachtler, Bangor, ME (US)

(72) Inventor: John A. Wachtler, Bangor, ME (US)

( * ) Notice: Subject to any disclaimer, the term of this patent is extended or adjusted under 35 U.S.C. 154(b) by 0 days.

(21) Appl. No.: 14/510,082

(22) Filed: Oct. 8, 2014

(51) Int. Cl.
*A63B 69/36* (2006.01)

(52) U.S. Cl.
CPC ..... *A63B 69/3608* (2013.01); *A63B 2243/0029* (2013.01)

(58) Field of Classification Search
USPC ..... 473/212, 213, 214, 215, 266, 276
See application file for complete search history.

(56) References Cited

U.S. PATENT DOCUMENTS

| | | | | |
|---|---|---|---|---|
| 5,203,570 | A * | 4/1993 | Graham | 473/214 |
| 6,719,639 | B2 * | 4/2004 | Novosel, Sr. | 473/213 |
| 2007/0173338 | A1 * | 7/2007 | Williams | 473/212 |
| 2011/0136582 | A1 * | 6/2011 | Georgescu | 473/212 |
| 2012/0052969 | A1 * | 3/2012 | Schutte | 473/214 |

* cited by examiner

*Primary Examiner* — Nini Legesse
(74) *Attorney, Agent, or Firm* — Calif Tervo; Palomar Patent

(57) ABSTRACT

A golf swing training aid for training the golfer to swing a club such that the club's shaft stays in the same plane as the golfer's trailing forearm during the initial and final portion of the swing generally comprises a band for attachment to the golfer's trailing forearm and front and rear guide rods projecting downward from the band such that
there is a gap between the rod's distal ends such that the shaft of the golf club can be swung into and out of the gap for guidance during the swing. The distal ends of the guide rods include a visual distinction that is seen peripherally by the golfer.

8 Claims, 4 Drawing Sheets

GOLF SWING TRAINING AID

FIELD OF THE INVENTION

This invention relates to a training device for improving a golfer's swing, and more specifically to a device worn on the golfer's trailing forearm

BACKGROUND OF THE INVENTION

Golf is often a difficult and exasperating sport to learn. One particularly difficult skill to develop is swinging the club such that the shaft of the club stays in the same plane as the trailing forearm of the golfer during the final portion of the swing and impact with the ball. This motion produces the most efficient and accurate stroke.

Accordingly, there has been a need for a training device that will aid the golfer in developing this swing technique.

SUMMARY OF THE INVENTION

The invention is an aid, for attachment to the forearm of a golfer's trailing arm, for training the golfer to swing the club such that the shaft of the club stays in the same plane as the golfer's trailing forearm during the initial and final portion of the swing.

An elastic band goes around the golfer's trailing forearm near the elbow. Attached to the band are front and rear guide rods that project downward on the front and rear sides, respectively, of the forearm such that, with the golfer in the ball address position, there is a gap between the distal ends of the rods such that the shaft of the golf club can be swung into and out of the gap for guidance during the swing. The distal ends of the guide rods include a visual distinction that is seen peripherally by the golfer. The band includes means for adjusting the relative angle of the rods.

Other features and many attendant advantages of the invention will become more apparent upon a reading of the following detailed description together with the drawings wherein like reference numerals refer to like parts throughout.

DETAILED DESCRIPTION OF THE INVENTION

Figure 1:
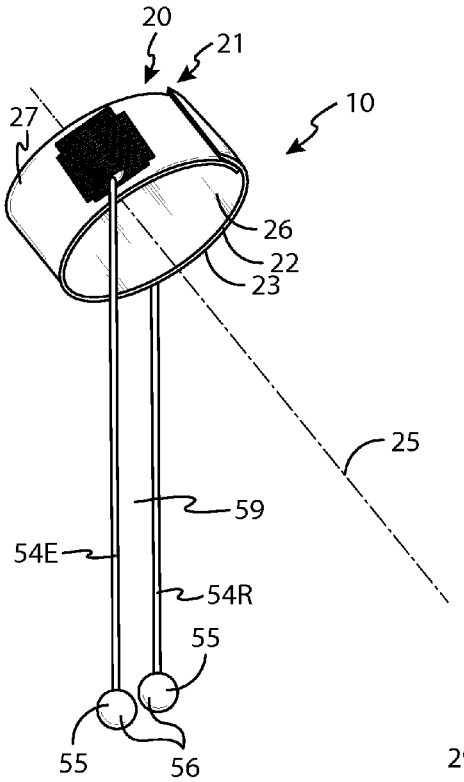
FIG. 1 is a perspective view of an exemplary embodiment of the golf swing training aid of the invention as would be worn on a golfers forearm.
Figure 2:
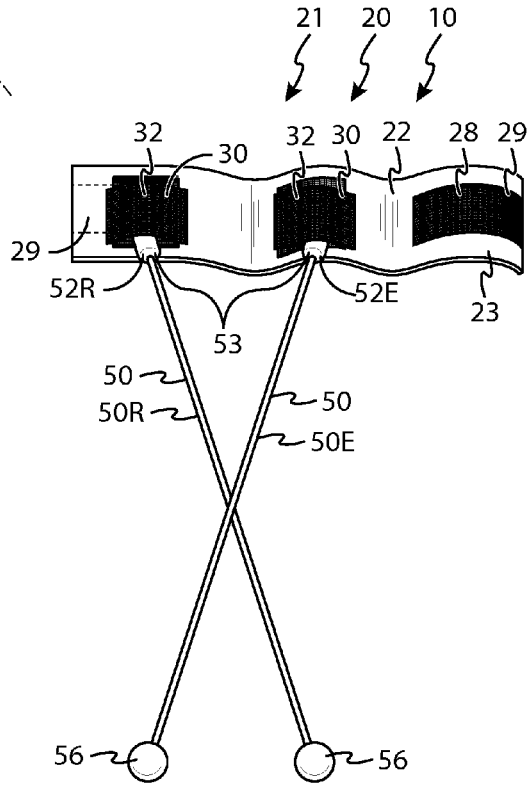
FIG. 2 is a plan view of the aid of FIG. 1 with the forearm band opened.
Figure 3:
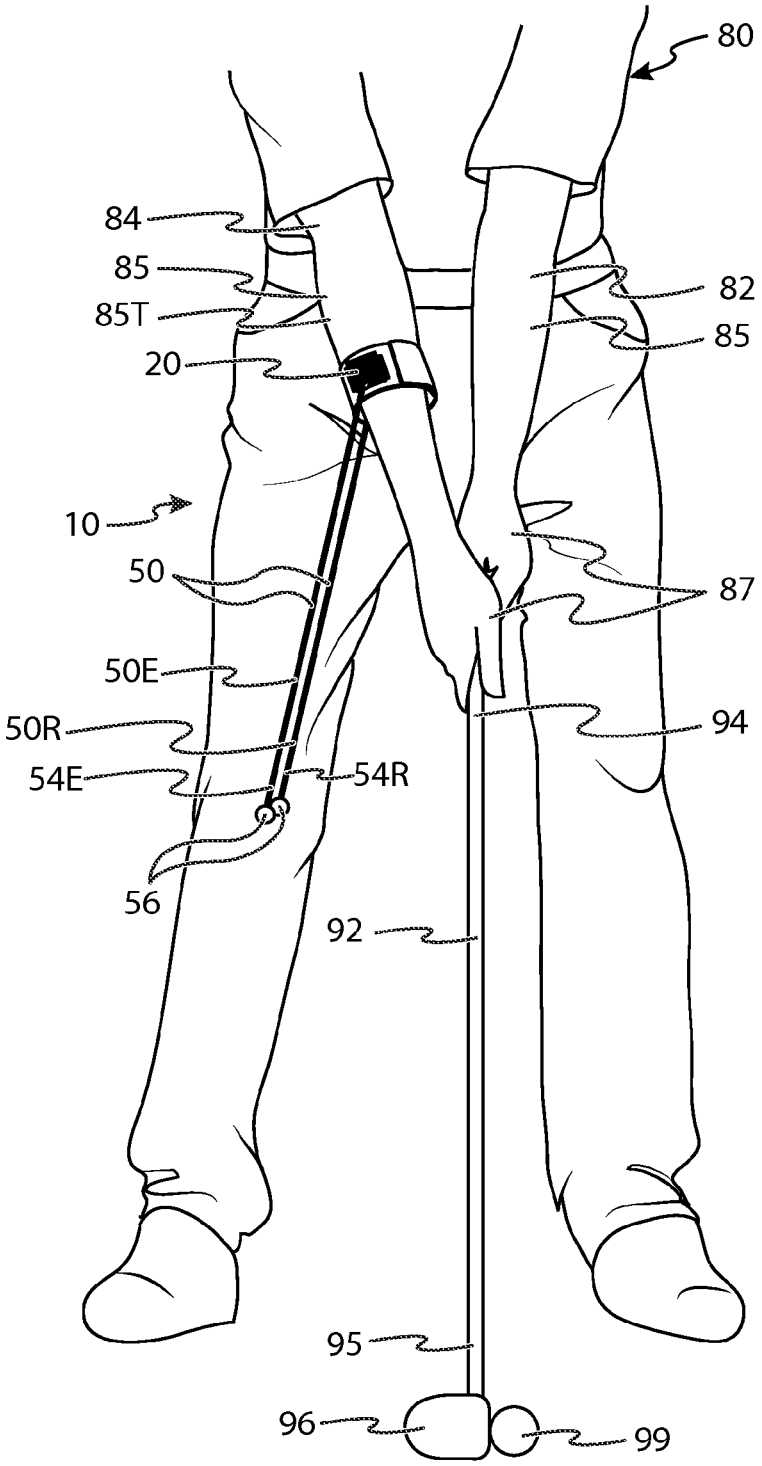
FIG. 3 is front view of a golfer in the ball address position wearing the aid.
Figure 4:
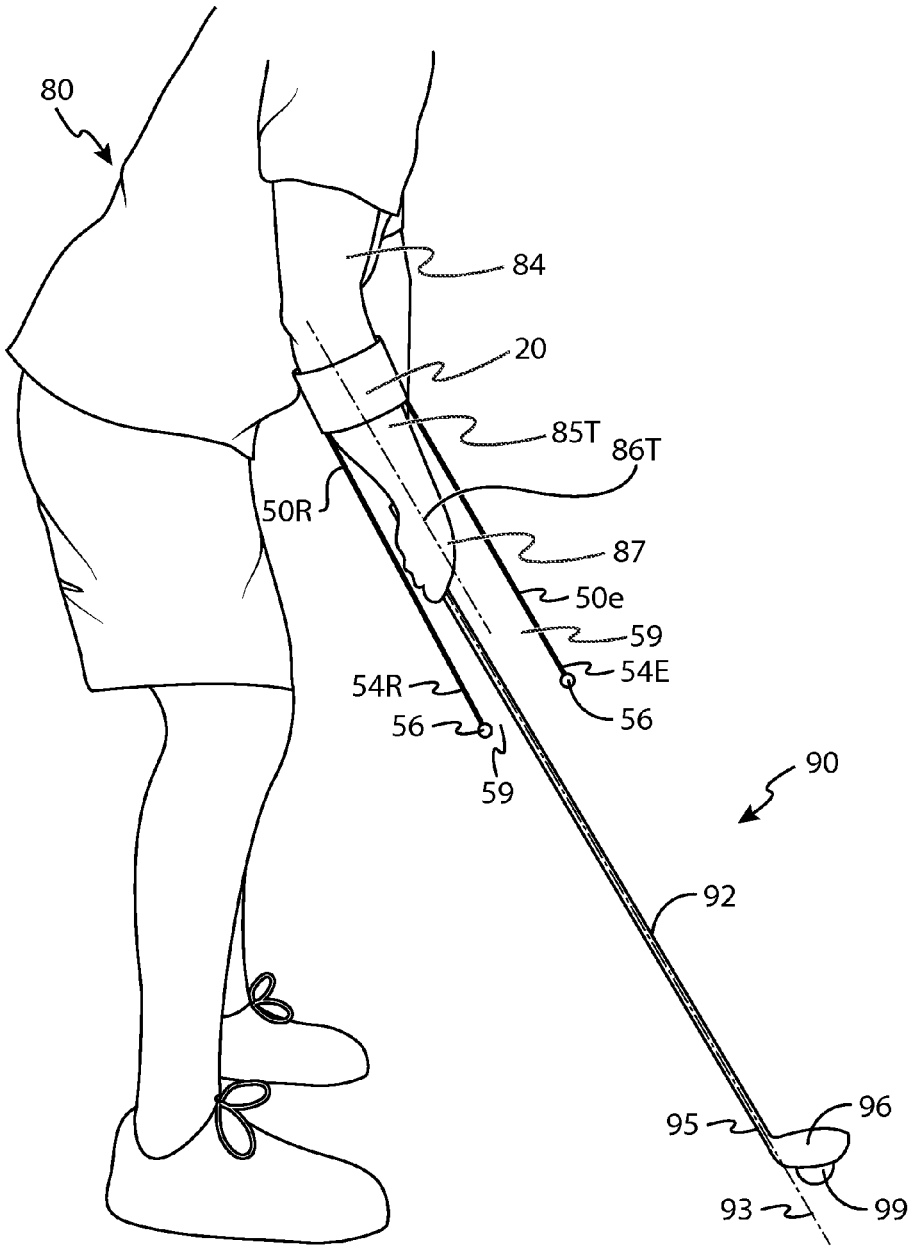
FIG. 4 is a side view of a golfer in the ball address position of FIG. 3 wearing the aid.
Figure 5:
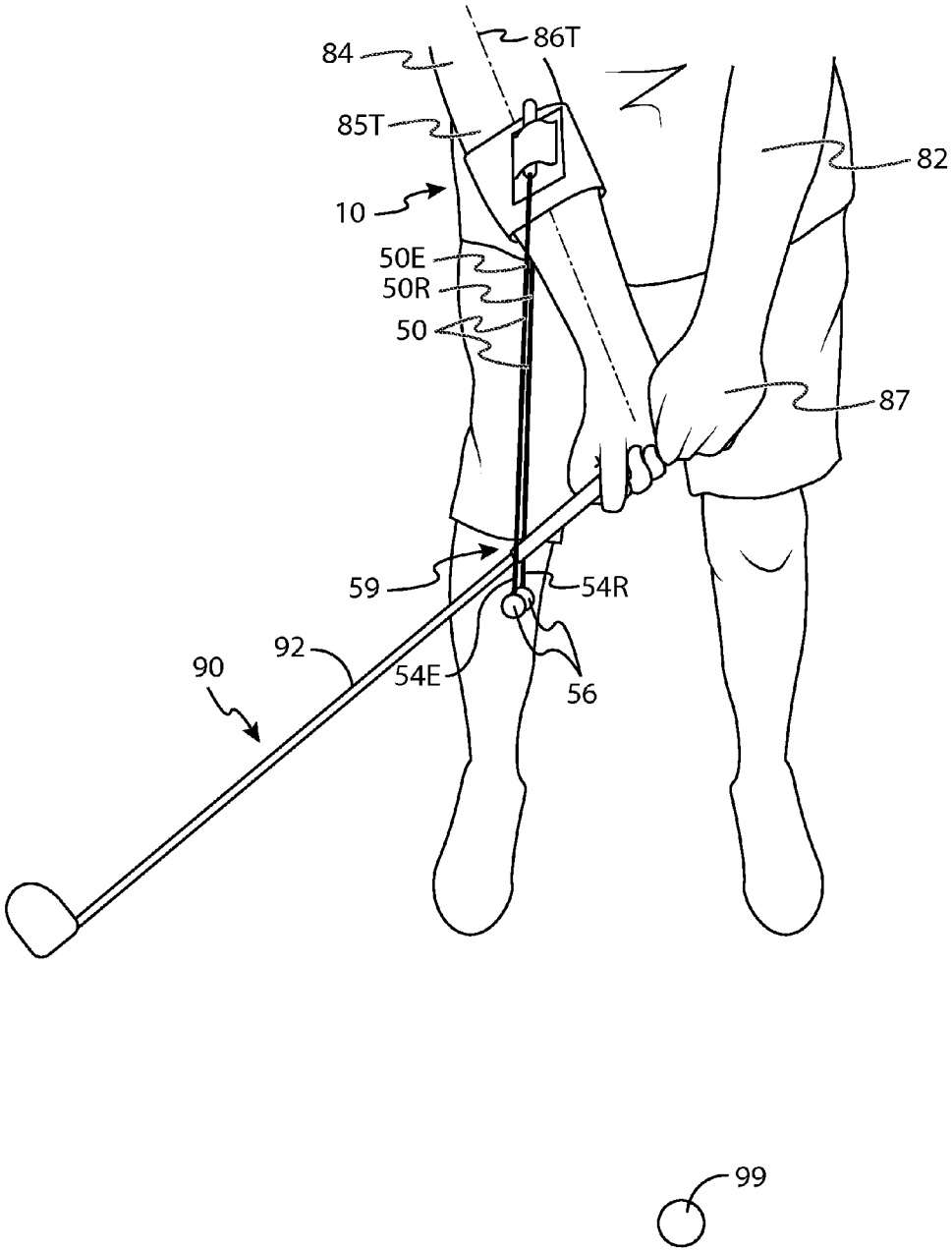
FIG. 5 is an elevated front perspective view of a golfer wearing the aid and beginning a backstroke or approaching impact with the club.

With reference now to the drawings, there is shown in FIG. 1 a perspective view of an exemplary embodiment of the golf swing training aid 10 of the invention, in FIG. 2 a plan view of aid 10 of FIG. 1 in an open position and in FIGS. 3-5, aid 10 in use as attached to a golfer 80. Golfer 80 has a lead arm 82, that is, the left arm for a right handed golfer, and a trailing arm 84, that is, the right arm for a right handed golfer 80. As seen in FIGS. 4 and 5, the golfer's trailing forearm 85T has a longitudinal axis 86T. Golf Club 90 generally comprises a shaft 92 having a longitudinal axis 93, a grip end 94 and a head end 94 fastened to a head 96.

Aid 10 includes attachment means 20, such a base portion 21, such as forearm band 22, for attaching a pair of guide rods 50 to a golfer's trailing forearm 85T. Forearm band 22, as shown, is an elastic belt 23 having a width of 2.5 to 3 inches with fastening means 28, such as mating hook loop fasteners areas 29 to snugly secure belt 23 to trailing forearm 85T. Although an elastic belt 23 is shown as the attachment means 20 for the guide rods 50, it will become apparent that many other embodiments of attachment means 20 are possible and would known to one of skill in that art. For example, a continuous band, a hinge-biased clamp, or a resilient clamp could be attached to trailing forearm 85T. Or each rod 50 could have its own attachment means 20. There are minor advantages or disadvantages of various possible attachment means 20 that can fulfill the basic requirement of attaching rods 50 to trailing forearm 85T so as to hold rods 50 in a desired orientation during a golf swing while still being relatively easy to attach, adjust, and remove. Such modifications and substitutions can be made by a person skilled in the art without departing from the spirit and scope of the invention.

In FIG. 1, belt 23 is positioned as it would be in use around trailing forearm 85T of golfer 80. When worn, belt 23 has a central axis 25 that is coincident with the longitudinal axis 86T of trailing forearm 85T as seen in FIG. 4. Rods 50 include a rear or interior guide rod 50R and front or exterior guide rod 50E. Each guide rod 50R, 50E includes a proximal end 52R, 52E connected to belt 23 and a distal end 54R, 54E that is free. Distal ends 54R, 54E are separated by a gap 59. During the swing, golfer 80 is looking at golf ball 99 such that distal ends 54R, 54E are outside of the main focus. Distal ends 54R, 54E include a visual distinction or prominence 55, such as bright, shiny or fluorescent coloring or a sphere 56 or both, for providing golfer 80 with additional visual awareness of the positions of distal ends 54R, 54E during the swing so that golfer 80 can swing shaft 92 into and out of gap 59.

Belt 23 attaches rods 50 to trailing forearm 85T, typically about 1.5 to 2 inches below the elbow and such that distal ends 54R, 54E of rods 50 are spaced apart approximately the width of trailing forearm 85T and are roughly parallel. In the exemplary embodiment, rods 50 are cylindrical fiberglass with a length of about 14 inches. Rods 50 may be made of any suitable material that will maintain the spaced positioning of distal ends 54R, 54E at the desired location. The length of rods 50 depends partially upon how they are fastened to belt 23 and partially on the length of trailing forearm 85T of golfer 80; the longer the trailing forearm 85T, the longer the rods 50 must be. Each golfer 80 may alter the length to fit their needs.

As best seen in FIG. 2, in the exemplary embodiment, belt 23 includes fastening means 30 for rods 50 for fastening rods 50 to belt 23 and for adjusting the angle of rods 50 relative to axis 25 of belt 23 and for adjusting the length of rods 50 extending below belt 23. Fasteners 30 fasten rods 50 to base portion 21, such as belt 23, in any desirable manner. Preferably, the angles of rods 50 to belt axis 25 are adjustable so as to accommodate different size trailing forearms 85T and desired positioning of distal ends 54R, 54E. Fasteners 30 may also be used to make some adjustments in the length of rods 50. In the exemplary embodiment, proximal ends 52R, 52E are trapped and held in position under a hook/loop fastener flap 32 on the exterior 27 of belt 23. Hook/loop material 53 may be fastened to proximal ends 52R, 52E of rods 50 to facilitate the fastening. There are minor advantages or disadvantages of various possible fasteners 30 that can fulfill the basic requirement of attaching rods 50 to belt 23 so as to hold rods 50 in a desired orientation during a golf swing. Such modifications and substitutions can be made by a person skilled in the art without departing from the spirit and scope of the invention. In FIG. 2, with elastic belt 23 not on trailing forearm 85T and open, rods 50 assume a position that is not pertinent.

FIGS. 3-5 show aid 10 in use as attached to trailing forearm 85T of a golfer 80. FIG. 3 is front perspective view of aid 10 on trailing forearm 85T of the trailing arm 94 of golfer 80 with golfer 80 in the ball address position. FIG. 4 is a trailing arm side view of aid 10 on trailing forearm 85T golfer 80 in the ball address position of FIG. 3. FIG. 5 is a front view of aid 10 on golfer 80 who is either beginning a backstroke or approaching impact with golf ball 99.

FIGS. 3 and 4 show golfer 80 gripping club 90 with lead arm 82 and trailing arm 84. Preferably, as seen side view in FIG. 4, longitudinal axis 86T of trailing forearm 85T is parallel with longitudinal axis 93 of shaft 92 such that they swing substantially in the same plane.

Proximal end 52R of interior guide rod 50R is attached to base portion 21 such that, with golfer 80 in the ball address position, interior rod 50R projects forward and downward such that distal end 54R is below the golfer's hands 87, and proximal end 52E of exterior guide rod 50E is attached to base portion 21 such that, with the golfer 80 in the ball address position, exterior rod 50E projects forward and downward such that distal end 54E is below the golfer's hands 87 and exterior rod 50E is separated from and roughly parallel with interior guide rod 50R such that there is a gap 59 between distal ends 54R, 54E such that shaft 92 can be swung into gap 59 for guidance during the swing. Interior rod 50R may project roughly in a plane with the interior side of trailing forearm 85T and hand. Exterior rod 50E may project roughly in a plane with the exterior side of trailing forearm 85T and hand 87 and roughly parallel to interior guide rod 50R.

In the front view of FIG. 5, club shaft 92 is shown during the swing in gap 59 between rods 50. Shaft 92 would be in this position as it was just entering the backstroke or on the downstroke as it was approaching impact with ball 99. On the swing, golfer 80 guides shaft into gap 59 and keeps it within gap 59 until it exits near impact with ball 99. As best seen in FIG. 4, club head 96 is in impact position as it exits gap 95. Gap 59 may be slightly changed in position to alter the angle of the plane of the swing.

Although a particular embodiment of the invention has been illustrated and described, various changes may be made in the form, composition, construction, and arrangement of the parts herein without sacrificing any of its advantages. For example, there are many possible ways to attach the rods to the forearm and many ways to adjust the angle or length of the rods. Therefore, it is to be understood that all matter herein is to be interpreted as illustrative and not in any limiting sense, and it is intended to cover in the appended claims such modifications as come within the true spirit and scope of the invention.

I claim:

1. A training aid for guiding a shaft of a golf club during swinging by a golfer, the golfer having a trailing arm including a trailing forearm: said aid comprising:

means for attaching a pair of guide rods to the trailing forearm of a golfer; said guide rods including:

an interior guide rod including:

a proximal end; and a distal end;

an exterior guide rod including:

a proximal end; and a distal end; said proximal end of said interior guide rods attached to said attaching means such that, with the golfer in a ball address position with said attaching means attached to the trailing forearm, said interior rod projects forward and downward; and said proximal end of said exterior guide rod attached to said attaching means such that, with the golfer in the ball address position with said attaching means attached to the trailing forearm, said exterior rod projects forward and downward and separated from and roughly parallel with said interior guide rod such that there is a gap between said distal ends such that the shaft can be swung into the gap for guidance during the swing.

2. The training aid of claim 1 wherein:

said distal ends of said guide rods include a visual distinction.

3. The training aid of claim 1 wherein:

said distal ends of said guide rods include a visual distinction.

4. The training aid of claim 1 wherein:

said base portion, when worn, has a central axis and includes means for adjusting said rods to a desired angle relative to the central axis.

5. The training aid of claim 1 wherein:

said distal ends of said guide rods include a visual distinction.

6. The training aid of claim 1 wherein:

said base portion has a central axis and means for adjusting said rods to a desired angle relative to the central axis.

7. A training aid for guiding a shaft of a golf club during swinging by a golfer, the golfer having a trailing arm including a trailing forearm: said aid comprising:

a base portion adapted for attachment to the trailing forearm of a golfer:

an interior guide rod including:

a proximal end; and a distal end;

an exterior guide rod including:

a proximal end; and a distal end; said proximal end of said interior guide rods attached to said base portion such that, with the golfer in a ball address position with said base attached to the trailing forearm, said interior rod projects forward and downward; and said proximal end of said exterior guide rod attached to said base portion such that, with the golfer in the ball address position with said base attached to the trailing forearm, said exterior rod projects forward and downward and separated from and roughly parallel with said interior guide rod such that there is a gap between said distal ends such that the shaft can be swung into the gap for guidance during the swing.

8. A training aid for guiding a shaft of a golf club during swinging by a golfer, the golfer having a trailing arm including a trailing forearm and a hand; the trailing forearm having a longitudinal axis, the trailing forearm and hand having an exterior side and an interior side when the golfer is in a ball address position; said training aid comprising:

a base portion adapted for attachment to the trailing forearm: and an interior guide rod including:

a proximal end; and a distal end;

an exterior guide rod including:

a proximal end; and a distal end; said proximal end of said interior guide rods attached to said base portion such that, with the golfer in the ball address position with said base attached to the trailing forearm, said interior rod projects forward and downward roughly in a plane with the interior side of the trailing forearm and hand; and said proximal end of said exterior guide rod attached to said base portion such that, with the golfer in the ball address position with said base attached to the trailing forearm, said exterior rod projects forward and downward roughly in a plane with the exterior side of the trailing forearm and hand and parallel with said interior guide rod such that there is a gap between said distal ends such that the shaft can be swung into the gap for guidance during the swing.

* * * * *